United States Patent [19]

Clarke et al.

[11] Patent Number: 4,877,572

[45] Date of Patent: Oct. 31, 1989

[54] PROCESS FOR THE PRODUCTION OF PBT CARPET YARN

[75] Inventors: Peter G. Clarke, Bad Homburg, Great Britain; Ulrich Mirwaldt, Offenbach/Main; Dietmar Wandel, Hanau, both of Fed. Rep. of Germany

[73] Assignee: Davy McKee Aktiengesellschaft, Frankfurt am Main, Fed. Rep. of Germany

[21] Appl. No.: 271,437

[22] Filed: Nov. 14, 1988

[51] Int. Cl.[4] ..... D01D 5/16; D01F 6/62

[52] U.S. Cl. ..... 264/555; 264/103; 264/130; 264/210.2; 264/210.6; 264/210.7; 264/210.8; 264/211.15; 264/211.17; 57/350; 57/908

[58] Field of Search ..... 264/103, 130, 210.2, 264/210.7, 210.8, 211.15, 211.17, 168, 210.6, 234, 345, 555; 57/350, 908

[56] References Cited

U.S. PATENT DOCUMENTS

| | | | |
|---|---|---|---|
| 3,861,133 | 1/1975 | Frankfort et al. | 264/168 |
| 3,908,248 | 9/1975 | Schmid et al. | 28/1.4 |
| 3,975,488 | 8/1976 | Patterson | 264/210.6 |
| 4,096,226 | 6/1978 | Martin et al. | 264/168 |
| 4,159,617 | 7/1979 | Allan | 264/345 |
| 4,755,336 | 7/1988 | Deeg et al. | 264/103 |

FOREIGN PATENT DOCUMENTS

| | | |
|---|---|---|
| 2011813 | 10/1970 | Fed. Rep. of Germany . |
| 2037217 | 2/1971 | Fed. Rep. of Germany . |
| 223950 | 11/1972 | Fed. Rep. of Germany . |

*Primary Examiner*—Hubert Lorin

*Attorney, Agent, or Firm*—Allegretti & Witcoff, Ltd.

[57] ABSTRACT

A process for the production of high-quality carpet yarn from PBT having an intrinsic viscosity of 0.9 to 1.2 comprising an integrated spinning-draw texturing process, employing a transport speed to the texturing unit of at least 1,800 m/min.

4 Claims, No Drawings

PROCESS FOR THE PRODUCTION OF PBT CARPET YARN

BACKGROUND OF THE INVENTION

The invention relates to a process for the production of carpet yarn from polybutyleneterephthalate (PBT) having an intrinsic viscosity of 0.9 to 1.2, by means of integrated spinning-draw texturing in which drawn filaments are conveyed to a texturing unit at a speed of at least 1,800 m/min.

THE PRIOR ART

PBT carpet yarns are already known. Thus, DE-A 22 23 950 describes shag carpets starting from staple fibers, which are obtained by melt spinning PBT with an intrinsic viscosity of approximately 0.8, winding up the filaments at a speed of 610 m/min., subsequently drawing at at temperature of 80° C., stuffer box texturing, and, finally, thermosetting at 150° C. for 18 min.

Analogous to this is the process of DE-A 20 11 813, in which the concluding stage of an 18-minute thermosetting of the fiber strand likewise finally determines the processing speed, and thus the profitability of the process.

Also, PBT staple fibres with a somewhat higher intrinsic viscosity (at least 0.76), which should also be suitable for carpets, are disclosed in DE-B 20 37 217. Although designated as "bulked", these fibers are not textured, but only drawn, and are subsequently set for 5 min at 145° C. Here, too, the level of profitability is essentially determined by the time-consuming step of thermosetting.

While the first two publications mentioned above do not disclose the viscosity of the fibers, the intrinsic viscosity of the fibers according to DE-B 20 37 217 lies, in the majority of cases, considerably below that of the starting PBT, and in the most unfavorable case, some 20% thereunder. The polymer degradation thereby occuring leads, among other things, to the release of lower, generally cyclic, oligomers, and to a corresponding contamination of the cooling air, the used water vapour and the environmental air. Cleaning of these media by means, for example, of activated carbon, as specified by newer environmental legislation, means additional energy requirements and the disposal of the purification mass. Furthermore, the partial PBT degradation causes a greater unevenness in the quality of the yarn.

It is obvious that setting stages lasting several minutes are not compatible in their time requirements with modern spinning-draw texturing processes operating at speeds of 2,000 or 3,000 m/min. The known integrated spinning-draw texturing processes do not use PBT as the polymer.

One such integrated process is described, for example, for Polyamide-6 and -6.6 in the US-A No. 4 096 226, in which a texturing device in accordance with US-A No. 3 908 248 is preferably used. The latter should also be suited for polyethyleneterephthalate (PETP). Although a limiting definition of the speed is not stated, speeds mentioned are quite low, in general 50 to 100 m/min. and, for nylon-6, 800 to 1,200 m/min.

If an attempt is made to work the example given in US-A No. 40 96 226 for Polyamide-6 using PETP, essentially amorphous filaments, if any, are produced. In addition to other deficient characteristics, these PETP fibers have no long-lasting bulkiness. Obviously, the stated texturing device is only suited for PETP if work is carried out at lower, and thus less economical, speeds of a few hundred m/min., as is already known for PBT.

SUMMARY OF THE INVENTION

The object of the present invention is to provide a method for producing PBT carpet yarn on a more economical basis than the processes of the prior art. The yarn quality should be at least equivalent to that which can be obtained in the conventional process comprising several separate stages, and the process should minimize pollution of the environment.

The object is achieved in accordance with the invention by using an integrated spinning-draw texturing process consisting of the following steps:

(a) Melt spinning polybutyleneterephthalate having an intrinsic viscosity of 0.9 to 1.2, and a water content of not more than 50 ppm by weight, at a temperature of 245° to 270° C., and a spinning draw down of 1:20 to 1:100;

(b) Cooling the filaments in a quenching shaft by means of turbulence-free air flowing perpendicularly to the direction of the filaments at a speed of 0.4 to 0.8 m/sec.;

(c) Coating the cooled filaments with an oil layer in the amount of at least 0.5% relative to the filament weight by means of an oil in water emulsion of at least 20% oil concentration;

(d) Drawing the filaments between two heated roller systems, the temperature of the first system lying in the range of the glass transition temperature plus/minus 30° C., and that of the second system being at least 100° C. higher, the stretching ratio being high enough that the break elongation of the finished filaments is not in excess of 45%;

(e) Feeding the drawn filaments from the second roller system at a speed of at least 1800 m/min. to a texturing unit, in which the filaments are blown and deformed in three dimensions with air having a temperature at least as high as that of said second roller system;

(f) Discharging the filaments from the texturing unit to a cooling unit for a residence time sufficient to cool the filaments below glass transition temperature;

(g) Removing the filaments from said cooling unit by means of an unheated, third roller system, operating at a speed of a least 10% lower than that of said second roller system;

(h) Controlling the process conditions of stage (a) to (g) in such a manner that the intrinsic viscosity in stage (j) is at maximum 5% lower than that in stage (a);

(i) Intermingling the filaments by means of an air-blowing nozzle at an air pressure sufficient to attain an entangling node number of at least 12 per meter; and (j) Winding up the filaments.

The wound up PBT carpet yarns obtained through the process in accordance with the invention are characterized by the following properties:

An intrinsic viscosity of at least 0.86;

An individual filament titer of at least 16 dtex;

A filament cross-sectional ratio related to a trilobal profile of at least 2.2;

A shrinkage in boiling water of less than 1.0%;

A bulk level of at least 15% with thread development at 120° C.;

A bulkiness defined as the difference of the bulk level with yarn development at 120° C. to that at room temperature of at least 9% absolute;

A dyeability with disperse dyestuffs at not more than 100° C. without carrier;

An outstanding anti-staining behavior.

Upon processing into a carpet, the fibers confer the following properties:

Positive optical qualities;

An outstanding covering property; and

A high elasticity and recovery capacity.

These excellent fiber characteristics, which are superior to PBT fibers produced in the conventional manner as regards bulk and recovery, were completely surprising, and, in consideration of the negative outcome of the experiment with the closely related PETP, described above, were also unexpected.

This surprising success is presumably to be attributed to the precise and optimized adjustment of the numerous process parameters, with respect to one another, as well as to a uniquely defined polymer with relatively narrow viscosity limits.

The PBT polymer used has an intrinsic viscosity of 0.9 to 1.2, preferably 0.9 to 1.1, measured in a mixture of 3 parts by weight of phenol and 2 parts by weight of 1,2-dichlorobenzene at 25° C. and at a concentration of 0.5 g/100 ml. The water content of the PBT should be as low as possible, at most 50 ppm, preferably at most 30 ppm, to prevent a partial hydrolytic degradation of the polymer. The usual additives, such as, for example delustrants are permissible, but otherwise PBT as pure as possible should be used. PBT with slightly varying viscosity or small amounts of a comonomer may be used in accordance with the invention, but the limits to lower thread quality are in this case flexible.

Depending on local conditions, the process is started from PBT chips or from a molten mass coming directly from polycondensation. The direct method is to be preferred, since the underwater granulation of the PBT is thereby eliminated, and the polymer melt is practically free of water. The polymerization itself can take place in accordance with whatever process is desired, such as is described, in US-A No. 4 680 376 and US-A No. 4 499 261.

The melt spinning takes place at a temperature in the range of 245° to 270° C. and a spinning draw down of 1:20 to 1:100, preferably at 258° to 265° C. and 1:30 to 1:50. The residence time in the melt condition is to be limited, and should not exceed, in the case of PBT chips, from the time of melting up to the time of leaving the spinning nozzles, 8 min., preferably approximately 4 min. As this first stage influences considerably the ratio of the intrinsic viscosity of the starting PBT to that of the filaments to be produced, a particularly careful control of the process conditions in this stage is of particular significance.

Corresponding to its purpose as carpet yarn, the individual filaments should have preferably a trilobal cross-section, and a final titer of at least 16 dtex, preferably 20 to 30 dtex, with a total titer of 600 to 6,000 dtex.

The period of cooling in the quenching shaft should be long enough to solidify the filaments and prevent adhesion of the individual filaments. Immediately following solidification, the filaments are oiled and drawn. The temperature of the draw roller systems is determined in accordance with the glass transition temperature, and is dependent on the molecular structure of the polymers. Preferably, the temperature of the first roller system lies in the range of 20° to 60° C., and that of the second system in the range of 120° to 200° C. The drawing ratio is adjusted by regulating the relative speeds of both roller systems so that the elongation at break of the finished yarn does not exceed 45%, preferably 25 to 35%. In general, the ratio lies in the range of 3.0 to 4.5.

The second roller system also serves to convey the filaments to the texturing unit at a transport speed of at least 1,800 m/min., preferably 2,000 to 2,800 m/min. The temperature of the texturing air should at least equal that of the second roller system, preferably in the range of 170° to 220° C.

The subsequent cooling of the textured filaments is accomplished by means of any cooling unit used in the art, preferably a perforated, rotating cylinder, through which environmental air is suctioned by means of a connected low pressure system. The residence time of the filaments on the cylinder should be sufficient to ensure cooling to below glass transition temperature, and ranges generally between 1 and 6 sec. The filaments are removed by means of a third unheated roller system, and further transported at a speed of at least 1,500 m/min., preferably 1,700 to 2,500 m/min.

The final intermingling takes place in the conventional manner, the air pressure being sufficient to ensure an entangling node number of at least 12, preferably at least 20 per meter.

Through the integration, in accordance with the invention, of spinning, drawing, and texturing into a single process, there is obtained, in addition to a higher profitability, a particularly uniform and reproducible yarn quality. In particular, defects and damage from an intervening winding step are obviated.

The low overall residence time of the integrated process makes possible, together with the low water content of the starting polymer and the optimized temperature conditions, a very efficient and careful processing of the PBT, and thus a minimized pollution of the environment with PBT degradation products.

EXAMPLE 251 g/min. of PBT, with an intrinsic viscosity of 0.93 and a water content of 29 ppm, are spun at 260° C., with a speed of 650 m/min. and a spinning draw down of 1:38, through a spinning nozzle with 64 holes with a trilobal cross-section.

After the solidification of the filaments in a quenching shaft with cooling air streaming in perpendicularly to the direction of the filaments at a speed of 0.55 m/sec., the filaments are coated with an oil layer of 0.8% relative to the filament weight, and the 64 filaments are combined into a strand.

The drawing takes place immediately thereafter on two roller systems, the temperature of the first system being 55° C., that of the second system 160° C. The draw ratio equals 1:3.3.

With a transport speed of the second roller system of 2,145 m/min., the filaments are conveyed to a jet-texturing unit, and, by means of air at 210° C., are blown and deformed in a three dimensional manner.

The filaments are discharged continuously from the texturing unit to a cooling cylinder, where the filaments are cooled to a temperature below 40° C., the residence time being approximately 1.5 sec.

The cooled filaments are removed from the cooling cylinder by a third, unheated roller system, and transported further along at a speed of 1,888 m/min. Before the final wind-up, an entangling node number of 22 per meter is imparted to the yarn by means of an air blowing nozzle.

The resulting, wound-up yarn has the following characteristic values:

Intrinsic viscosity: 0.90
Tenacity: 25 cN/tex
Elongation at break: 28%
Boiling water shrinkage: 0.4%
Individual filament titer: 21 dtex
Filament cross-sectional ratio: 2.8
Bulk level (120° C.): 18%
Bulkiness: 9%

The resultant yarns can be processed into carpets of outstanding quality, and of excellent dyeability with disperse dyestuffs at not more than 100° C. without carrier additives.

We claim:

1. A process for the production of polybutyleneterephthalate carpet yarn having a bulk level of at least 15% with thread development at 120° C., and a bulkiness defined as the difference of the degree of bulk with thread development at 120° C. to that at room temperature, of at least 9% absolute, by means of an integrated spinning-draw texturing process comprising:

(a) melt spinning polybutyleneterephthalate having an intrinsic viscosity of 0.9 to 1.2, and a water content of not more than 50 ppm by weight said spinning being carried out at a temperature of 245° to 270° C., and a spinning draw down of 1:20 to 1:100;

(b) cooling the filaments in a quenching shaft by means of turbulence-free air flowing perpendicularly to the direction of the filaments at a speed of 0.4 to 0.8 m/sec.;

(c) coating the cooled filaments with an oil layer in the amount of at least 0.5% relative to the filament weight by means of an oil in water emulsion;

(d) drawing the filaments between two heated roller systems, the temperature of the first system lying in the range of 30° C. above or below the glass transition temperature, and that of the second system being at least 100° C. higher, the stretching ratio being high enough that the break elongation of the finished filaments is not in excess of 45%;

(e) feeding the drawn filaments from the second roller system at a speed of at least 1800 m/min. to a texturing unit, in which the filaments are blown and deformed in three dimensions with air having a temperature at least as high as that of said second roller system;

(f) discharging the filaments from the texturing unit to a cooling unit for a residence time sufficient to cool the filaments below the glass transition temperature;

(g) removing the filaments from said cooling unit by means of an unheated, third roller system, operating at a speed of at least 10% lower than that of said second roller system;

(h) controlling the process conditions of stage (a) to (g) in such a manner that the intrinsic viscosity in stage (j) is at maximum 5% lower than that in stage (a);

(i) intermingling the filaments by means of an air-blowing nozzle at an air pressure sufficient to attain an entangling node number of at least 12 per meter; and (j) winding up the filaments.

2. A process in accordance with claim 1, in which said polybutyleneterephthalate is fed directly to step (a) in the form of a molten mass.

3. A process in accordance with claim 1, in which polybutyleneterephthalate chips are fed to step (a).

4. The process of claim 1 in which said intermingling step (i) is performed after step (j).

* * * * *